US005386078A

United States Patent [19]

Hanulik

[11] Patent Number: 5,386,078

[45] Date of Patent: Jan. 31, 1995

[54] PROCESS FOR DECONTAMINATING RADIOACTIVE METAL SURFACES

[75] Inventor: Jozef Hanulik, Zürich, Switzerland

[73] Assignee: Deco-Hanulik AG, Canada

[21] Appl. No.: 188,250

[22] Filed: Jan. 28, 1994

[30] Foreign Application Priority Data

Feb. 1, 1993 [CH] Switzerland ..... 00285/93

[51] Int. Cl.[6] ..... G21F 9/00

[52] U.S. Cl. ..... 588/18; 588/4; 134/3; 134/4; 134/29

[58] Field of Search ..... 134/3, 4, 29; 588/15, 588/20, 4, 18

[56] References Cited

U.S. PATENT DOCUMENTS

| | | | |
|---|---|---|---|
| 4,508,641 | 4/1985 | Hanulik | 252/628 |
| 4,587,043 | 5/1986 | Murray et al. | 252/626 |
| 5,008,044 | 4/1991 | Hanulik | 252/626 |
| 5,024,805 | 6/1991 | Murray | 376/305 |

*Primary Examiner*—Donald P. Walsh

*Assistant Examiner*—Ngoclan T. Mai

*Attorney, Agent, or Firm*—Speckman, Pauley & Fejer

[57] ABSTRACT

A method for decontaminating a radioactively contaminated metallic object. A radioactively contaminated metallic object is placed into a first bath and thus contacted with a non-radioactive, aqueous solution containing formic acid until the formic acid is completely stoichiometrically depleted thereby forming an aqueous, stoichiometrically depleted solution. The metallic object is then placed into a second bath of the same chemical composition. The non-radioactive, aqueous solution of the second bath is also preferably completely stoichiometrically depleted. The concentration of the aqueous solution containing formic acid is preferably about 0.3 Mol/l. These steps are repeated until the residual radioactivity level of the metallic object is beneath a permissible threshold level, such as 0.37 $Bq/cm^2$. The radioactive metallic oxides and metallic hydroxides are sedimented out, and the sludge is solidified with cement and subsequently decontaminated.

18 Claims, No Drawings

PROCESS FOR DECONTAMINATING RADIOACTIVE METAL SURFACES

BACKGROUND OF THE INVENTION

1. Field of the Invention

This invention relates to a method for decontaminating radioactive metal surfaces with an aqueous solution containing formic acid.

2. Description of Prior Art

Several different methods are known for decontaminating radioactive metal surfaces. The use of fluoroboric acid to decontaminate radioactively contaminated surfaces is taught by U.S. Pat. No. 5,008,044. The method taught by the '044 patent is suited for decontamination of surfaces comprising metallic as well as mineral substances. The advantage of the method taught by the '044 patent is the high absorbency of the decontamination agent used, which provides a great stripping depth, making the method particularly suitable for cleaning medium and severely radioactively contaminated items of various materials. Appropriately, the method taught by the '044 patent is also used in decontamination efforts at Chernobyl, Russia. The high metallic content permits electrolytic regeneration of the metals. Decontamination of tanks is costly, however, and produces a large amount of waste because of the acid residue present. The toxicity of the decontamination agent poses an additional problem, particularly at higher temperatures, such as above 130° C., when the decontamination agent pyrolizes into toxic borofluoride.

Another decontamination method, taught by U.S. Pat. No. 4,508,641, uses formic acid and/or acetic acid as a decontamination agent and at least one reducing agent, such as formaldehyde and/or acetaldehyde. The '641 patent teaches a method for decontaminating reactor cooling coils, with which steel surfaces can be cleaned with relatively small quantities of chemicals and rinsing water, and wherein used decontamination solution is reprocessed. The addition of reducing agents causes the iron ions to remain stable in the solution, prohibiting the formation of compounds. In a system with closed loops, prohibiting the formation of compounds is crucial for preventing the formation of sediment from settling compounds. The iron compounds are only separated from the decontamination solution in a second step of the decontamination method taught by the '641 patent. Because the entire decontamination process takes place in a closed loop, either the decontamination agent must be continuously injected because it is stoichiometrically depleted, or high concentrations of the acids must be used. On the other hand, the decontamination of a tank does not present such problems. However, cleaning and decontaminating the entire cooling medium in a closed loop according to the decontamination method of the '641 patent is extremely problematic because of the formaldehyde that is present as a reducing agent. A complete decontamination below the permissible threshold of 0.37 Bq/cm, for example, is hardly possible. Nevertheless such complete decontamination of the entire cooling medium is not required inside the cooling loops of reactors.

SUMMARY OF THE INVENTION

It is an object of this invention to provide a decontamination method which uses a decontamination agent that is low in toxicity, a decontamination method which is economical, and a decontamination method which produces relatively little secondary waste.

This and other objects are achieved by a decontamination method according to this invention in which a radioactively contaminated metallic object is placed into a first bath and contacted with a non-radioactive, aqueous solution containing 0.05% to 5.0% volume formic acid, until the formic acid in the aqueous solution is nearly completely stoichiometrically depleted thereby forming an aqueous, stoichiometrically depleted solution. As used in this application, the term "non-radioactive" is intended to relate to an aqueous solution that is either completely free of radioactivity or has a very insignificant level of radioactivity.

In one preferred decontamination method according to this invention, the radioactively contaminated object is placed into a second bath of the non-radioactive, aqueous solution. In the second bath, the radioactively contaminated metallic object is then contacted with the nonradioactive, aqueous solution and this step is repeated until the radioactively contaminated metallic object has a residual radioactivity level below a permissible threshold level, and the radioactively charged metallic oxides and metallic hydroxides are sedimented out from the aqueous stoichiometrically depleted solutions forming a radioactive sediment. The radioactive sediment is solidified and separated from the aqueous, stoichiometrically depleted solution. The aqueous, stoichiometrically depleted solution may then be recycled by adding formic acid, for decontaminating other radioactively contaminated metallic objects.

A method of this type has the advantage that the solution baths need not be completely cleaned after each use. Therefore the level of secondary waste is relatively small. Only after the decontamination effort has been completed is the remaining aqueous solution completely cleaned with known agents.

In a decontamination method according to this invention where the radioactively contaminated metallic objects comprise lead, nickel or alloys containing lead or nickel, an oxidizing agent, preferably hydrogen hydroxide, is added to the aqueous solution containing formic acid.

DESCRIPTION OF PREFERRED EMBODIMENTS

Laboratory tests which illustrate the decontamination method of this invention are described in detail below. A radioactively contaminated metallic object weighing approximately 200 kg, which in this laboratory test was a crane hook, was placed into an empty polypropylene tank with a capacity of approximately 300 l. The entire metal surface area of the crane hook was estimated to be approximately 2 $m^2$. In a second step, 150 l of a 0.5% formic acid decontamination solution or agent was added to the bath. In a third step, the crane hook was left in the bath at an ambient temperature for 5 to 16 hours. Subsequently, the stoichiometrically depleted decontamination solution was pumped out. At this point the radioactivity of the used decontamination agent and the remaining radioactivity of the metallic object was measured, and the foregoing steps were repeated. These steps had to be repeated numerous times, depending on the extent of the radioactive contamination. After it was determined that the residual radioactivity of the crane hook was below the permissible threshold, the used decontamination agent was electrolytically treated in the same bath. The remaining sludge, comprising predominantly Fe, Fe $(OH)_x$, and other impurities, including the absorbed radioactivity, were solidified with cement after sedimentation and sanitized. In a final step, remaining water was then passed through an ion exchanger and subsequently delivered to a sewage treatment plant.

In other laboratory tests the time required for stripping a radioactive layer of metal from a sample of A43 steel was determined. The tests were performed on a sample weighing 200 g and having the dimensions of $50\times100\times5$ mm. From these laboratory tests it was determined that with a decontamination solution having a very low formic acid concentration, such as 0.3 Mol/l, metallic stripping could be very precisely controlled by altering the bath temperature. Thus, it was determined, for example, that with a bath temperature of 19° C. the stripping rate was 1.1 $mg/cm^2.hr$, while a bath temperature of 80° C. produced a stripping rate of 35 $mg/cm^2.hr$. As in the laboratory test previously discussed, the used radioactively contaminated solution was subjected to anodic oxidation by means of electrolysis. The iron hydroxide sludge formed in this laboratory test absorbed the radioactivity. After sedimentation, the remaining water was used for further decontamination.

A quantitative comparison between the method taught by U.S. Pat. No. 4,508,641 and a decontamination method according to this invention reveals that a decontamination method according to this invention produces 30 times less secondary waste than the method taught by the '641 patent. This comparison clearly shows the economic significance of the method of this invention.

The described method according to this invention can be used for decontamination of relatively large amounts of radioactive metal parts as well as for smaller decontamination operations. With large projects in particular the stoichiometrically depleted solution can be used again by adding an oxidation agent, such as $H_2O_2$, to the metals and nucleides dissolved therein. By such methods, the insoluble complexes are sedimented out of the solution which still has an acidity of approximately 3 to 3.5 pH. It is know that $Fe^{2+}(COOH)_2$ is soluble and therefore cannot bind radioactivity. With the addition of $H_2O_2$ the trivalent compounds, which are insoluble in water, are formed in this way:

$$Fe^{2+}(COOH)_2+H_2O_2\rightarrow Fe(OH)_3 \text{ and/or } Fe^{3+}(OH)_2(COOH)$$

$Fe(OH)_3$ as well as $Fe^{3+}(OH)_2(COOH)$ have relatively large absorption surfaces and are therefore particularly suited for binding up radioactivity. The sludge formed in this way can be separated by means of sedimentation and/or decantation and/or filtration and can then be solidified and disposed.

It is of course also possible to heat $Fe^{3+}(OH)_2(COOH)$ to approximately 150° C., so that it separates into the parts $Fe_2O_3$ radioactivity and $H_2O$ and $CO_2$.

Formic acid is again added to the aqueous solution which is free of radioactivity to a large degree until the aqueous solution again has the initial concentration, after which the metal part to be decontaminated is again inserted into the aqueous solution. In this way it is possible to perform one step after the other in the same tank with the same water proportion with only the addition of HCOOH, and the process can be repeated as often as required until the decontamination operation is complete.

It is of course necessary to dispose of the aqueous solution at the end of the decontamination operation. With the method according to this invention, this can again be performed by the addition of $H_2O_2$. To eliminate small amounts of radioactivity, an alkaline solution is added to the aqueous solution after a brief waiting period. Particularly suitable alkaline solutions are NaOH and $Ca(OH)_2$, depending on which nucleides are primarily present, namely Co-60, Cs-134, Cs-137 or U or Pu-isotopes. Subsequently, the sludge is separated as usual and the almost neutral aqueous solution is passed over a resin ion exchanger and transferred, free of radioactivity, into a sewage installation.

I claim:

1. In a method for decontaminating radioactive metal surfaces with an aqueous solution containing formic acid, the improvement comprising: contacting a radioactively contaminated metallic object with an aqueous solution consisting essentially of 0.05%–5.0% volume formic acid until the formic acid is nearly completely stoichiometrically depleted thereby forming an aqueous, stoichiometrically depleted solution comprising radtoactively charged metallic oxides and metallic hydroxides; repeating the contacting of the metallic object with an additional amount of the aqueous solution until the radioactively contaminated metallic object has a residual radioactivity level below a permissible threshold level; sedimenting out said radioactively charged metallic oxides and metallic hydroxides from the aqueous, stoichiometrically depleted solution, forming a radioactive sediment: separating the aqueous, stoichiometrically depleted solution from the radioactive sediment; and solidifying the radioactive sediment.

2. In a method according to claim 1, wherein the separated aqueous, stoichiometrically depleted solution is purified with resin ion exchange means to form deionized water.

3. In a method according to claim 1, wherein the aqueous, stoichiometrically depleted solution is electrolytically treated.

4. In a method according to claim 1, wherein formic acid is added to the separated aqueous, stoichiometrically depleted solution.

5. In a method according to claim 1, wherein the radioactively contaminated metallic object comprises at least one of nickel and lead and an oxidizing agent is added to the aqueous stoichiometrically depleted solution.

6. In a method according to claim 5, wherein the oxidizing agent is hydrogen peroxide.

7. In a method according to claim 1, further comprising maintaining a temperature of the aqueous solution between approximately 19° C. and approximately 80° C..

8. In a method according to claim 1, wherein the formic acid has a concentration of 0.1 to 1.0 Mol/1, and a stripping rate is controlled by a temperature of the aqueous solution.

9. In a method according to claim 1, wherein an oxidation agent is added to the aqueous, stoichiometrically depleted solution containing dissolved metals to form a radioactive nuclides sludge which is insoluble in water and the radioactive nuclides sludge is removed from the aqueous, stoichiometrically depleted solution.

10. In a method according to claim 9, wherein the oxidation agent is hydrogen peroxide ($H_2O_2$).

11. In a method according to claim 9, wherein the aqueous, stoichiometrically depleted solution is regenerated to an initial concentration by adding formic acid to the aqueous, stoichiometrically depleted solution.

12. In a method according to claim 11, Wherein all decontamination steps take place in a same bath.

13. In a method for decontaminating radioactive metal surfaces with an aqueous solution containing formic acid, the improvement comprising: contacting a radioactively contaminated metallic object with an aqueous solution consisting essentially of 0.05%–5.0% volume formic acid until the formic acid is nearly completely stoichiometrically depleted thereby forming an aqueous, stoichiometrically depleted solution: repeating the contacting of the metallic object with the aqueous solution until the radioactively contaminated metallic object has a residual radioactivity level below a permissible threshold level adding an oxidation agent followed by an alkaline solution to the aqueous, stoichiometrically depleted solution, to form radioactive sediment and separating the radioactive sediment from the aqueous solution.

14. In a method according to claim 13, wherein the oxidation agent is hydrogen peroxide ($H_2O_2$).

15. In a method according to claim 13, wherein the alkaline solution is one of sodium hydroxide (NaOH) and calcium hydroxide ($Ca(OH)_2$).

16. In a method according to claim 13, wherein the radioactive sediment is separated by at least one of filtration, decantanation and sedimentation.

17. In a method according to claim 13, wherein the separated aqueous, stoichiometrically depleted solution is discharged to a sewage system.

18. In a method for decontaminating radioactive metal surfaces with an aqueous solution containing formic acid, the improvement comprising: contacting a radioactively contaminated metallic object with an aqueous solution consisting essentially of 0.05%–5.0% volume formic acid and an oxidizing agent until the formic acid is nearly completely stoichiometrically depleted thereby forming an aqueous, stoichiometrically depleted solution comprising radioactively charged metallic oxides and metallic hydroxides; repeating the contacting of the metallic object with an additional amount of the aqueous solution until the radioactively contaminated metallic object has a residual radioactivity level below a permissible threshold level; sedimenting out said radioactively charged metallic oxides and metallic hydroxides from the aqueous, stoichiometrically depleted solution, forming a radioactive sediment; separating the aqueous, stoichiometrically depleted solution from the radioactive sediment; and solidifying the radioactive sediment.

* * * * *

UNITED STATES PATENT AND TRADEMARK OFFICE

CERTIFICATE OF CORRECTION

PATENT NO. : 5,386,078

DATED : January 31, 1995

INVENTOR(S) : Jozef HANULIK

It is certified that error appears in the above—identified patent and that said Letters Patent is hereby corrected as shown below:

On the Title page, item [73], at the Assignee line, delete "Deco-Hanulik AG, Canada" and in its place insert --Deco-Hanulik AG, Switzerland--.

Signed and Sealed this

Fourth Day of July, 1995

Bruce Lehman

*Attest:*

BRUCE LEHMAN

*Attesting Officer*

*Commissioner of Patents and Trademarks*